US006154884A

United States Patent [19]

Dehner

[11] Patent Number: 6,154,884

[45] Date of Patent: Dec. 5, 2000

[54] COMPOSITE WADERS HAVING LOWER WATER IMPERVIOUS SECTION AND UPPER BREATHABLE SECTION

[75] Inventor: James B. Dehner, Overland Park, Kans.

[73] Assignee: J.D. Industries, L.L.C., Kansas City, Kans.

[21] Appl. No.: 09/464,164

[22] Filed: Dec. 16, 1999

[51] Int. Cl.[7] ..... A41D 1/00

[52] U.S. Cl. ..... 2/69; 2/82

[58] Field of Search ..... 2/69.82, 79, 227

[56] References Cited

U.S. PATENT DOCUMENTS

| | | | |
|---|---|---|---|
| Re. 34,662 | 7/1994 | Keller | 2/82 |
| 4,858,342 | 8/1989 | Nicholson et al. | 36/109 |
| 4,912,860 | 4/1990 | Keller | 36/4 |
| 5,081,718 | 1/1992 | Carmen et al. | 2/227 |
| 5,867,828 | 2/1999 | Shih | 2/82 |
| 5,901,374 | 5/1999 | Foster | 2/82 |

OTHER PUBLICATIONS

Orvis Fishing and Outdoor 1999, pp. 84–97.
Fly Rod & Reel (Jan./Feb. 1999), pp. 41–43, 61–63.
DuPont Hytrel Advertisement.
Fly–Fishing Retailer (Sep. 1998), pp. 54–58.
Madison River Fishing Company 199 Fall Clearance and Christmas Catalog.
Fly Tackle Dealer (Jan. 1999), pp. 5–7).
Simms Fishing Products (1998) Catalog.
Cabela's Master Catalog (Spring 1999, Ed. II), pp. 360–367.
L. L. Bean Fly Fishing Catalog (1999), pp. 102–110.
Hodgman 1999 Product Catalog, pp. 2–15.
Alexander's Product Brochure.

*Primary Examiner*—Gloria M. Hale
*Attorney, Agent, or Firm*—Hovey, Williams, Timmons & Collins

[57] ABSTRACT

A composite wader (10) adapted to be worn by a fisherman includes a breathable upper section (12) together with a lower leg-receiving non-breathable section (14). The section (14) includes a pair of tubular legs (44, 46) each extending from a mid-thigh region of the wearer to the ankle region; in preferred forms, the legs (44, 46) include integral foot-receiving sections (60, 62). The upper section (12) is connected to the section (14) and extends upwardly to envelope the waist and trunk region of the user. Conventional suspenders (16) are used to maintain the waders in place. Provision of the breathable upper section (12) affords significant comfort to the wearer, while the lower non-breathable section (14) has superior durability qualities.

10 Claims, 1 Drawing Sheet

COMPOSITE WADERS HAVING LOWER WATER IMPERVIOUS SECTION AND UPPER BREATHABLE SECTION

BACKGROUND OF THE INVENTION

1. Field of the Invention

The present invention is broadly concerned with improved fisherman waders designed to be worn by a fisherman desiring to stand or walk in water during fishing. More particularly, the invention pertains to a composite wader adapted to be worn over the legs and trunk of a person and which includes an upper breathable section and a lower non-breathable section covering a substantial proportion of the wearer's legs between a mid-thigh region and the wearer's ankles. The composite wader thereby maximizes comfort to the user consistent with wear and tear resistance.

2. Description of the Prior Art

Conventional waders for fishermen are in the form of relatively loosely worn garments which cover the legs and trunk of a user. Waders have been produced in both boot foot and stocking foot designs (i.e., boot foot designs extend only to the ankles of the users and are connected to wading boots, whereas stocking foot designs have integral foot covers) and from a variety of materials. Traditionally, waders have been fabricated using neoprene fabrics or rubber coated canvas or nylon. These waders are very rugged and exhibit very significant wear and puncture resistance. However, neoprene and similar waders are deficient in that the fabric used is non-breathable, meaning that the fabric tends to entrap heat and moisture (perspiration). Thus, after a relatively short time, the wearer of these waders often becomes very hot and uncomfortable.

In more recent years, waders made of breathable fabrics such as Gore-Tex have been available. Breathable fabrics are designed to be permeable to water vapor but do not allow water in liquid form to pass through. Breathability in fabrics can be accomplished in several ways. Microporous polyurethane coatings can be applied to a fabric or as a separate laminate sheet material to form a breathable composite, or a breathable coating (e.g., polyurethane) may be squeegeed over a fabric surface. While breathable waders have ameliorated the comfort problems associated with conventional neoprene or other type non-breathable waders, they are deficient in terms of durability. That is, the breathable fabric is more susceptible to tears and punctures, which is a common hazard for fishermen wading across rocky stream beds and the like. Accordingly, many fishermen, while acknowledging the comfort characteristics of breathable waders, refuse to purchase breathables because of their lack of durability. Further, the cost of breathable waders is substantially greater than that of non-breathable designs, which also detracts from the attractiveness of the breathables.

There is accordingly a need in the art for an improved wader which accommodates the desires of users to have the durability and cost advantages of old style non-breathables, while at the same time incorporating the comfort features of breathable waders.

SUMMARY OF THE INVENTION

The present invention overcomes the problems outlined above and provides new types of composite waders made up of interconnected upper and lower sections. The lower section includes a pair of tubular legs of length to extend from a point between the waist and knees of a person wearing the waders and the ankle regions of the person; the upper section extends upwardly from this point to a region above the person's waist. The lower leg section of the waders is made up of a non-breathable, substantially water-impervious synthetic resin material, whereas the upper section is formed of breathable synthetic resin material.

In preferred forms, a full-trunk chest wader is provided wherein the upper section extends to a point just below the armpits of the wearer. Also, a stocking foot design is preferred, wherein the leg sections of the wader include integral foot-receiving segments. However, the invention is not limited to either full chest waders or a stocking foot design. Rather, the upper section of the wader can extend to any desired height, whereas the leg sections need only extend to the ankles of user to thereby allow connection to wading boots.

The breathable upper section of the waders is preferably formed of a fabric which includes a textured nylon having a polyester elastomer on the inner face thereof. A nylon tricot lining may be laminated to the inner elastomer ply if desired. On the other hand, the lower non-breathable section of the wader is advantageously formed of heat sealable nylon fabric having a polyurethane coating on the inner face thereof. Use of this combination of materials affords a number of advantages. First, the lower leg section has all of the desirable wear characteristics of conventional waders, whereas the upper section enveloping the upper thigh, waist and trunk areas of the user is breathable so that heat and moisture may permeate through the fabric. Furthermore, in the preferred design, the lower non-breathable section of the wader may be heat-sealed, thereby eliminating the expense associated with stitching and sealing of breathable materials. Hence, from the standpoints of comfort, durability and cost, the waders of the invention provide an optimum solution.

DETAILED DESCRIPTION OF THE PREFERRED EMBODIMENT

Figure 2:
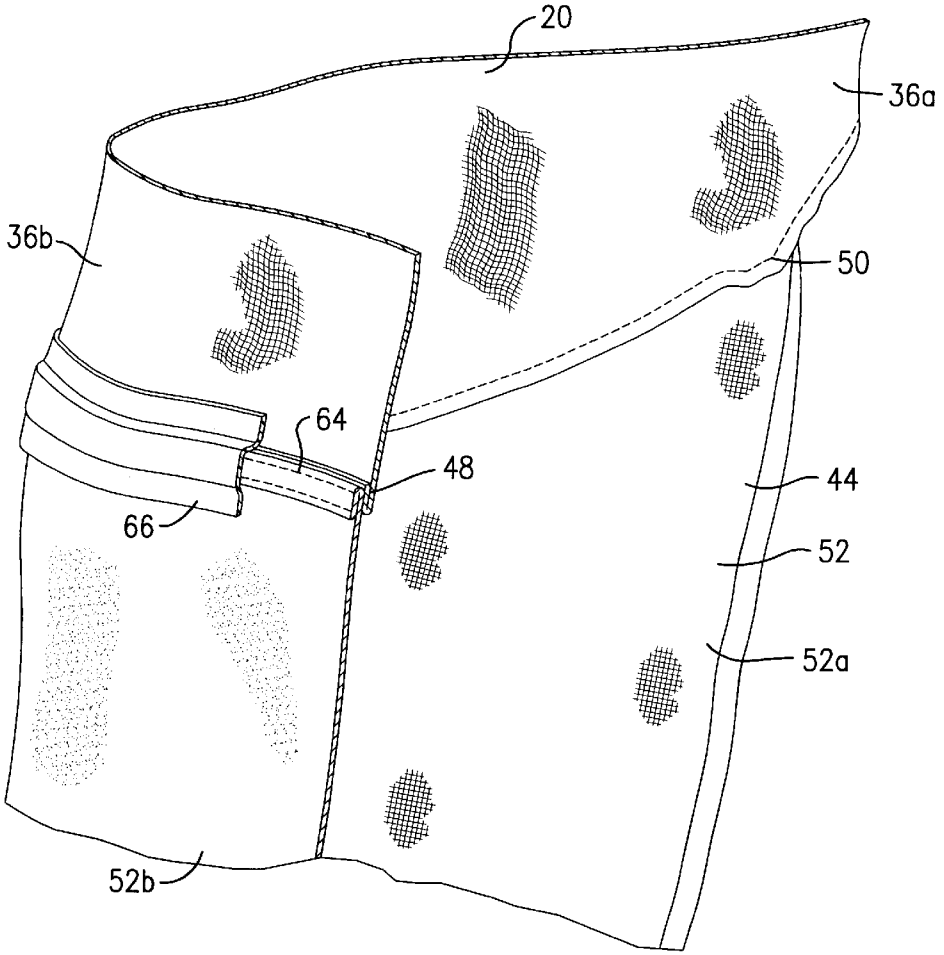
FIG. 2 is an enlarged sectional view illustrating the stitched joint between the upper and lower sections of the waders of FIG. 1.

Turning now to the drawings, waders 10 in accordance with the invention broadly include an upper section 12, lower section 14 and conventional, over-the-shoulder suspenders 16. The waders are adapted to be worn by a person and, in the form shown, extend from just under the armpits of a wearer downwardly to cover the ankles and feet of the wearer.

In more detail, the upper section 12 includes an upper tubular section 18 as well as a pair of separate tubular lower leg sections 20, 22. The section 12 has an upper margin 24 which is folded over and stitched as at 26. The upper margin also includes three pairs of metallic suspender buttons 28, 30 and 32, with each such pair including two spaced apart buttons affixed to the margin 24. As will be appreciated from FIG. 1, the upper section 12 is sized to extend from a point just below the armpits of the wearer past a waist section 34 to terminate in the lower tubular leg sections 20, 22.

Figure 1:
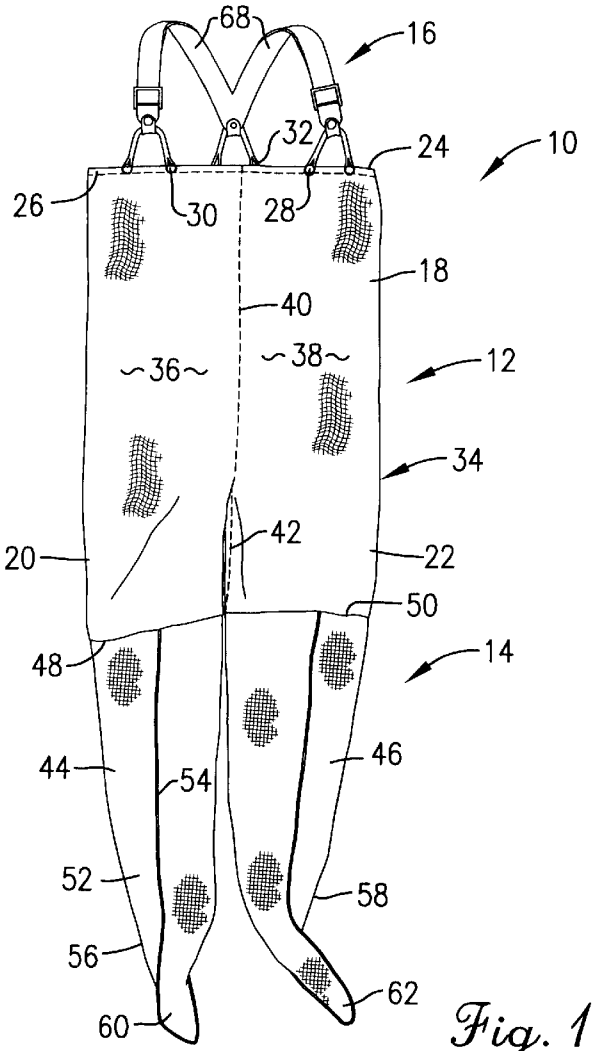
FIG. 1 is a front view of the preferred composite waders of the invention.

The upper section 12 is formed from apair of flexible fabric pieces 36, 38 which are interconnected along opposed front and rear stitch lines 40 and inner leg stitch lines 42, one of which is shown in FIG. 1. These stitch lines are supplemented on the inner face of the upper section 12, with a heat-applied seam sealing tape described in detail below.

The preferred material making up the pieces 36, 38 includes a breathable synthetic resin material allowing passage of body heat and moisture therethrough so as to render the waders more comfortable to wear. In particular, the most preferred breathable material is a three-ply laminate made up of an outermost two-ply mid-weight Supplex/Hytrel composite having laminated to the inner face thereof black nylon tricot material. The Supplex/Hytrel composite can be obtained from Top Value Fabrics, Inc. of Carmel, Ind. This composite is made up of a layer of 200 denier Supplex, a breathable textured nylon material sold by E. I. duPont de Nemours Co. of Wilmington, Del. The Hytrel component of the composite is likewise a duPont product and is a polyester elastomer bonded to the Supplex. Finally, the conventional black nylon tricot is laminated to the inner polyester elastomer Hytrel layer of the composite.

The preferred Supplex/Hytrel composite has the following properties: moisture vapor transmission rate—ASTM E-96 procedure B, 922 g/m$^2$/24 hrs., ASTM E-96 procedure BW, 4000 g/m$^2$/24 hrs.; waterproofness—Mullen hydrostatic resistance TM5512, 100 psi; abrasion resistance—ASTM D3884-92, 2.9% of original; air permeability—modified ASTM D737-75, 0.0817 cfm; drape resistance—Cusik drape tester, 70.2%; dynamic absorption AATCC 70-1994, 10.9%; and tear strength—ASTM D1424-83, 2242 g warp and 2525 g fill.

The lower section 14 is made up of two tubular legs 44, 46 each attached to a corresponding section 20, 22 along a lateral stitch line 48, 50. Each leg 44,46 is made up of a single piece of water-impervious, non-breathable nylon fabric 52 which has an axially extending heat sealed joint 54. As illustrated, each leg extends downwardly from the stitch line 48, 50 to an ankle region 56, 58. Although in the illustrated embodiment each leg also includes a foot-receiving section 60,62, it will be appreciated that the invention is not so limited. That is, the legs 44, 46 could be operatively connected to conventional wader boots if desired.

The preferred nylon fabric 52 forming each leg 44, 46 can be obtained from Lamco Technologies, Inc. of Monson, MA. This product is a woven nylon supplemented with an inner polyurethane coating. The product has the following preferred properties: Base fabric weight—test method 5041, 3.0 oz/yd$^2$ nominal; total weight—test method 5041, 5.50–6.50 oz/yd$^2$ maximum; grab breaking strength—test method 5100 (1 in. jaws), 200 lbs. minimum warp, 160 lbs. minimum fill; break away adhesion—MIL-C-83489,32 lbs/in. minimum warp; strip adhesion—test method 5970, 15 lbs/in. minimum warp; hydrostatic pressure—test method 5512, 170 lbs/sq. in. minimum; and air retention—test method MIL-C-83489, no leaks at 10 psig for 5 minutes.

Turning to FIG. 2, it will be observed that the joinder between section 20, and leg 44 is illustrated in detail. Thus, the section 20 has an exterior ply 36*a* made up of the Supplex fabric, whereas the inner surface is made up of the tricot ply 36*b*. Similarly, the fabric 52 includes an outer nylon ply 52*a* and an inner coating 52*b* of polyurethane. As illustrated, the stitch line 48 interconnects the section 20 and leg 44. To this end, the fabric pieces 36 and 52 are folded over as illustrated and stitching 64 extends therethrough for connection purposes. In order to complete the joint 48, seam sealing tape 66 is applied to the inner surfaces of the joined fabric pieces in bridging relationship thereto. This sealing tape is conventional and can be obtained from Highland Industries, Inc. of Framingham. Mass. The tape is formed of nylon tricot material combined with high melting synthetic resin films which serve as a barrier, providing abrasion and temperature resistance, and added strength. The inner face of the tape 66 has an adhesive layer formed of ester-based polyurethane and polyamid.

In application procedures, after the stitching 64 is completed, the tape 66 is applied to the inner surface of the material using a known heated roller applicator. This bonds the tape to the joint 48 as illustrated. Further, this same sealing tape 66 is applied to the other sewn joints of the wader, namely the front and rear stitch lines 40 and leg section stitch lines 42. The heat sealed joints 54 in the legs 44, 46 do not require seam tape, however.

The suspenders 16 are entirely conventional and as shown include a pair of straps 68 releasably connected to the button pairs 28–32 in the well known fashion.

In use, a person dons the waders 10 by inserting his feet and legs into the sections 44, 46 and then pulls the upper section 12 upwardly until margin 24 is just below the person's armpits. The suspenders 16 are then pulled over the shoulders and attached to suspend the waders and maintain them in place. It will be appreciated in this respect that the upper breathable section 12 extends from the armpit region of the person downwardly past the person's waist and ultimately to a point between the person's waist and knees. The lower leg sections 44, 46 on the other hand extend downwardly from this point to at least the ankle regions of the person. In the case of the full waders shown in FIG. 1, the integral foot section 60, 62 of course envelope the user's feet as well.

The use of essentially water-impervious, non-breathable lower leg sections 44, 46 means that the user can stand or walk in water without fear of leakage therethrough. At the same time, the strong, tear-resistant material used in the fabrication of the sections 44, 46 insures that the waders have a long life and are not subject to tearing or undue abrasion. On the other hand, the upper section 12, covering the region above the sections 44 and 46 throughout the trunk region of the user, is of breathable nature and thereby allows moisture and heat to permeate through the upper section to greatly increase the user's comfort during wearing of the waders. As can be appreciated, a substantial proportion of the perspiration and body heat from the user is centered in the trunk region, rather than the legs and feet, and accordingly the composite design of the waders of the invention adequately conducts heat and moisture away from the user.

I claim:

1. Waders adapted to be worn over the legs and trunk of a person and comprising interconnected upper and lower sections, said lower section including a pair of tubular legs of length sufficient to extend from a point between the waist and knees of said person to at least the ankle region of the person, said upper section being connected to the upper ends of said legs and extending upwardly therefrom to a point above the waist of the person, said upper section adapted for coupling with suspenders to extend over the shoulders of the person in order to suspend the waders, said lower section being formed of a first, non-breathable, substantially water-impervious synthetic resin material, said upper section being formed of a second breathable synthetic resin material.

2. The waders of claim 1, said upper section extending to a point just below the armpits of said person.

3. The waders of claim 1, said first material being heat sealable nylon.

4. The waders of claim 3, said nylon material having a polyurethane coating on the inner face thereof.

5. The waders of claim 1, said second material comprising a textured nylon having a polyester elastomer on the inner face thereof.

6. The waders of claim 5, said second material further including a nylon tricot lining laminated to said polyester elastomer.

7. The waders of claim 1, said upper and lower sections being interconnected by stitching to form a stitched joint.

8. The waders of claim 7, including seam sealing tape applied to the inner surface of said stitched joint and bridging said upper and lower sections.

9. The waders of claim 8, said tape comprising aweb of nylon tricot having a polyurethane adhesive on one face thereof.

10. The waders of claim 1, each of said tubular legs including a lowermost foot-receiving section.

* * * * *